United States Patent [19]

Grable

[11] Patent Number: 4,759,545

[45] Date of Patent: Jul. 26, 1988

[54] PORTABLE BASKETBALL GOAL

[76] Inventor: David I. Grable, Box 364, Scottsville, Tex. 75688

[21] Appl. No.: 31,274

[22] Filed: Mar. 30, 1987

[51] Int. Cl.[4] ..... A63B 63/08

[52] U.S. Cl. ..... 273/1.5 R; 248/DIG. 10; 248/188.1; 272/1 B; D21/201

[58] Field of Search ..... 273/1.5, 55 D; 272/1 B; D21/201; 248/188.1, DIG. 10, 158, 150; 40/606

[56] References Cited

U.S. PATENT DOCUMENTS

| | | | |
|---|---|---|---|
| D. 264,740 | 6/1982 | Merino et al. | D21/201 |
| 1,043,387 | 11/1912 | Astruck | 248/188.1 X |
| 1,270,004 | 6/1918 | Chappell | 248/188.1 X |
| 1,631,227 | 6/1927 | See | 248/DIG. 10 X |
| 2,818,254 | 12/1957 | Dunn | D21/201 X |
| 2,916,184 | 12/1959 | Hartley et al. | 248/DIG. 10 X |
| 3,716,234 | 2/1973 | Lancellotti | 248/158 X |
| 3,900,194 | 8/1975 | Ward et al. | 272/1 B |
| 3,908,992 | 9/1975 | Cunningham et al. | 273/55 D |
| 4,613,136 | 9/1986 | Raba et al. | 248/DIG. 10 X |

FOREIGN PATENT DOCUMENTS

| | | | |
|---|---|---|---|
| 605246 | 2/1926 | France | 248/188.1 |

*Primary Examiner*—Paul E. Shapiro
*Attorney, Agent, or Firm*—John M. Harrison

[57] ABSTRACT

A portable basketball goal for location on the pool deck of a swimming pool, which includes a base adapted to seat on the pool deck and internally receive a first quantity of water for ballast and externally receive a second quantity of water or other ballast, a backboard support extending upwardly from fixed or removable attachment to the base and a backboard and hoop mounted on the extending end of the backboard support and projecting over the swimming pool. The portable basketball goal can be located at any point along the deck lip or edge of the pool deck and is adapted and located for shooting basketball goals while a player or players are swimming.

32 Claims, 1 Drawing Sheet

PORTABLE BASKETBALL GOAL

BACKGROUND OF THE INVENTION

1. Field of the Invention

This invention relates to basketball goals and more particularly, to a portable basketball goal which includes as a first element, a base shaped to internally contain a first supply of water as ballast and externally contain a second quantity of water or other ballast. The base is designed for seating on a pool deck and an upwardly-extending backboard support is fixedly or removably attached to the base. A backboard provided with a hoop is attached to the opposite end of the backboard support and the base is positioned such that the backboard and hoop extend over the swimming pool. In a preferred embodiment, the upward-standing backboard support is removably bolted to the base in angular relationship to better facilitate storage and shipping and a fill plug and companion drain plug are provided in the backboard support and the base, respectively, for filling the hollow bottom segment of the backboard support and the hollow base with water. Alternatively, a liquid or non-liquid ballast such as sand, bricks and similar heavy material can be placed in a base container shaped in the base, in order to further secure the portable basketball goal on the deck of a swimming pool. A fill plug can also be provided in the base itself, under circumstances where the backboard support is removably attached to the base.

In recent years various water sports, including volleyball, water polo and basketball have seen increasing popularity in private swimming pools. One of the problems inherent in playing basketball while swimming is that of locating a hoop in a desirable, secure position to facilitate shooting baskets from the water. Since various activities other than basketball are many times planned for the swimming pool area, it is also desirable to provide a basketball goal assembly which is portable and easily assembled and disassembled to free the pool deck area for parties and other activities.

2. Description of the Prior Art

Various types of basketball goals and portable basketball goals in particular, are known in the art. U.S. Pat. No. 2,818,254, dated Dec. 31, 1957, to B. J. Dunn, discloses a "Swimming Pool Basket Ball Apparatus". The apparatus of this invention is characterized by a backboard supported by a frame which is attached by means of suction cups to the deck area of a swimming pool, wherein the hoop extending from the backboard projects over the edge of the pool and over the water in the swimming pool. The forward segment of the supporting frame engages the lip of the pool and a box is provided in the frame for containing sand or other ballast, in order to maintain the suction cups firmly in contact with the pool deck surface. U.S. Pat. No., 3,025,058, dated Mar. 13, 1962, to R. N. Brumfield, discloses a "Portable and Adjustable Basketball Goal". The basketball goal detailed in this patent is characterized by a vertical support extending from a base which is fitted with rollers and is provided with a backboard and net in conventional fashion, such that the entire basketball goal assembly can be moved from place to place by means of the rollers. A "Portable and Adjustable Miniature Basketball Goal" is disclosed in U.S. Pat. No. 3,669,450, dated June 13, 1972, to John W. Mason. The basketball goal apparatus detailed in this patent includes a base adapted to rest on a flat supporting surface and carries a vertical standard, to which is secured a backboard and a hoop. The base includes a platform for receiving an anchor and has flat, vertically extending front and side walls surrounding the front and side edges of the base. Braces extend between the base and the vertical standard to secure the vertical standard in a vertical position and the braces are confined within the boundaries of the walls and are completely shielded by the walls, to minimize the danger of physical injury from collision with the goal or the brace. U.S. Pat. No. 3,841,631, dated Oct. 15, 1974, to Edward M. Dolan, discloses a "Portable Basketball Backstop Construction". The backstop construction includes a hollow, yieldable, rubber-like container which is designed for filling with a sufficient volume of water to immovably fix and stabilize the backstop at a desired playing location. The backstop is capable of convenient diassembly for storage in minimum space and the several parts of the construction are rearrangeable for other purposes, such as a table, during storage. The base includes a frame structure supporting the container in leak-proof manner and is provided with wheels for moving the base when the container is empty.

It is an object of this invention to provide a new and improved portable basketball goal which is characterized by a base member adapted to internally contain a first supply of water and externally contain a second quantity of water and/or other ballast, an upward-standing backboard support having one end fixedly or removably secured to the base member and a backboard and hoop attached to the opposite end of the backboard support and extending over a swimming pool when the base member is located on the deck of the swimming pool near the deck lip.

Another object of the invention is to provide a portable basketball goal which is capable of containing ballast, including liquid ballast such as water, and non-liquid ballast, for maintaining the backboard and hoop in an extended, secure position over the swimming pool while the base is located on the deck of the swimming pool.

Still another object of this invention is to provide a new and improved portable basketball goal which is characterized by a hollow base capable of receiving both liquid and non-liquid ballast for maintaining the base in secure position on the deck of a swimming pool. A backboard support is removably attached to the base in angular relationship and supports a backboard and hoop over the swimming pool.

Yet another object of the invention is to provide a new and improved portable basketball goal which is provided with a base member constructed of pipe to define a polygon for receiving a supply of water therein and further defining a base container for receiving additional liquid or non-liquid ballast, with an upwardly-extending backboard support having one end removably attached to the base and the opposite end fitted with a backboard and hoop which extend over a swimming pool when the base is located on the deck of the swimming pool near the deck lip.

SUMMARY OF THE INVENTION

These and other objects of the invention are provided in a new and improved portable basketball goal for shooting baskets while swimming, which portable basketball goal is characterized by a base member constructed of pipe to define a circle or a polygon and adapted to receive both liquid and non-liquid ballast, with a hollow backboard support extending upwardly from the base in angular and fixed or removable relationship and a backboard and hoop removably secured to the extending end of the backboard support by means of a bracket, for shooting baskets from the swimming pool.

BRIEF DESCRIPTION OF THE DRAWINGS

The invention will be better understood by reference to the accompanying drawings, wherein.

DESCRIPTION OF THE PREFERRED EMBODIMENTS

Figure 1:
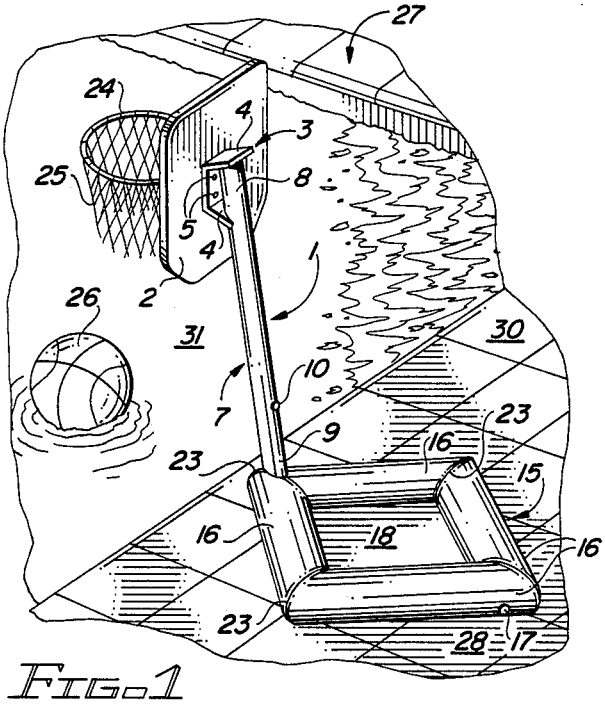
FIG. 1 is a perspective view of a preferred embodiment of the portable basketball goal of this invention located in functional position on the deck of a swimming pool.

Referring initially to FIG. 1 of the drawings, the portable basketball goal of this invention is generally illustrated by reference numeral 1. The portable basketball goal 1 is characterized by a shaped backboard 2 which can be constructed of plywood, fiberglass or other durable material known to those skilled in the art. The backboard 2 is mounted on the projecting plate end 8 of a backboard support 7, while the opposite or base end 9 of the backboard support 7 is secured to the base 15. The base 15 rests firmly, but portably, on the pool deck 28 of a swimming pool 27, such that the hoop 24, which is bolted or otherwise secured to the backboard 2 in conventional fashion, extends over the edge of the deck lip 30 and over the water 31 in the swimming pool 27. Accordingly, it will be appreciated from a consideration of the portable basketball goal 1 illustrated in FIG. 1, that persons who are swimming in the swimming pool 27 are able to shoot baskets through the hoop 24 and the net 25 from the water 31 using the basketball 26.

Figure 3:
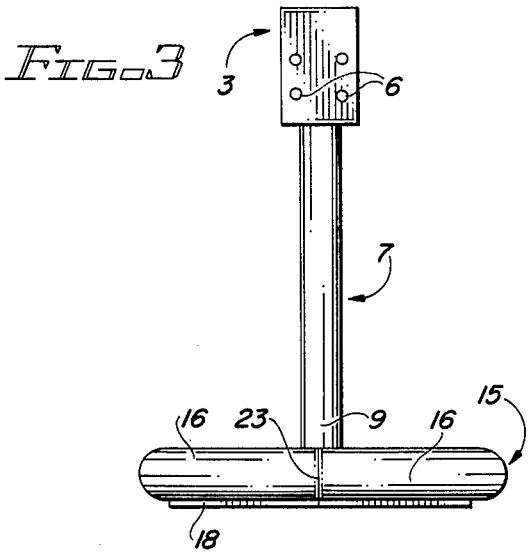
FIG. 3 is a front perspective view of the base and backboard support of the portable basketball goal illustrated in FIGS. 1 and 2.

Referring now to FIGS. 1–5 of the drawings, in a preferred embodiment of the invention the backboard 2 of the portable basketball goal 1 is secured to the plate end 8 of the backboard support 7 by means of a backboard bracket 3, provided with outwardly extending plate flanges 4 at each end and cooperating plate bolts 5, which extend through bolt openings 6 located in the backboard plate 3, as illustrated in FIG. 3. In a most preferred embodiment of the invention, these plate bolts 5 are characterized by lag bolts or screws which extend through the bolt openings 6 provided in the backboard bracket 3 and threadibly engage the backboard 2, to tightly, but removably, secure the backboard 2 to the backboard bracket 3 and the plate end 8 of the backboard support 7, according to the knowledge of those skilled in the art. In a first preferred embodiment of the invention, the base end 9 of the backboard support 7 is welded or otherwise fixedly secured to the base 15 at one of the leg welds 23 which join companion pipe legs 16 in a square configuration, as illustrated in the drawings. Since the pipe legs 16 are hollow and define a leg interior 14, respectively, and the hollow base end 9 of the backboard support 7 is welded to the pair of companion pipe legs 16, water can be introduced into a fill opening (not illustrated) which is closed by a support fill plug 10, provided in the backboard support 7. This action fills the hollow base end 9 of the backboard support 7 and the leg interior 14 of the pipe legs 16, in order to provide liquid ballast to help secure the portable basketball goal 1 on the pool deck 28 in the configuration illustrated in FIG. 1. Furthermore, when it is desired to move the portable basketball goal 1 from the position on the pool deck 28 as illustrated in FIG. 1 to another location , the drain plug 17 can be removed from a drain opening (not illustrated) provided in one of the pipe legs 16, to drain the water ballast from the pipe legs 16 and the base end 9 of the backboard support 7. In another preferred embodiment of the invention a base plate 18 spans the bottom sides of each of the pipe legs 16, in order to provide a base container 22 which is defined by the pipe legs and the base plate 18, for containing additional ballast. The base container 22 is also designed to serve as a vessel for containing water for washing the feet prior to entering the swimming pool 27. Furthermore, the base plate 18 is preferably welded or otherwise secured to the pipe legs 16 in a waterproof manner, in order to facilitate filling the base container 22 with water for additional ballast, as deemed necessary, to maintain the portable basketball goal 1 in the secure, yet portable position illustrated in FIG. 1. Such additional ballast is sometimes needed, for example, under circumstances of high wind or when adults are playing basketball and the force with which the basketball 26 strikes the hoop 24 and the backboard 2 is significant. Alternatively, the base container 22 can be filled with sand, bricks, rocks or other non-liquid ballast, as desired.

Figure 6:
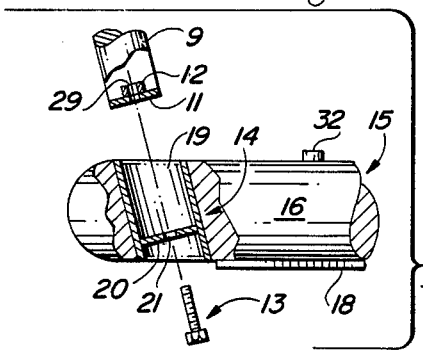
FIG. 6 is an exploded view of a preferred assembly for removably securing the backboard support to the base.

Referring now to FIG. 6 of the drawings, in yet another preferred embodiment of the invention the backboard support 7 is removably attached to the base 15 at the base end 9 by means of a mount sleeve 19 which is inserted in an opening that is cut or otherwise provided in the ends of a pair of the pipe legs 16 which are joined at one of the leg welds 23. The mount sleeve 19 is preferably welded or otherwise secured in the bevelled ends of these companion pipe legs 16 and is fitted with a sleeve plate 20, which is welded or otherwise secured in transverse relationship across the bore and near the bottom of the mount sleeve 19. A sleeve plate opening 21 is drilled or otherwise provided in the center of the sleeve plate 20, in order to accommodate a base end bolt 13, as hereinafter described. Furthermore, the base end 9 of the backboard support 7 is capped by a base end plate 11, which is fitted with a base end nut 12 and a corresponding base end plate opening 29. The base end nut 12 is welded or otherwise fixedly secured to the center of the base end plate 11, while the base end plate 11 is in turn welded to the base end 9 of the backboard support 7. Accordingly, when the base end 9 of the backboard support 7 is inserted in the mount sleeve 19 and the base end plate 11 is seated against the sleeve plate 20, the base end plate opening 29 and the sleeve plate opening 21 are aligned and the base end bolt 13 can be inserted upwardly through the registering sleeve plate opening 21 and base end plate opening 29, as illustrated in FIG. 6, to threadibly engage the base end nut 12 and secure the backboard support 7 tightly to the base 15. Furthermore, since the mount sleeve 19 isolates the base end 9 of the backboard support 7 from the leg interior 14 of each of the pipe legs 16, water ballast can be poured into the pipe legs 16 through an alternative opening (not illustrated) which is closed by a base fill plug 32 and communicates with the leg interior 14 of each of the pipe legs 16, without interfering with the base end-to-mount sleeve 19 connection.

Figure 4:
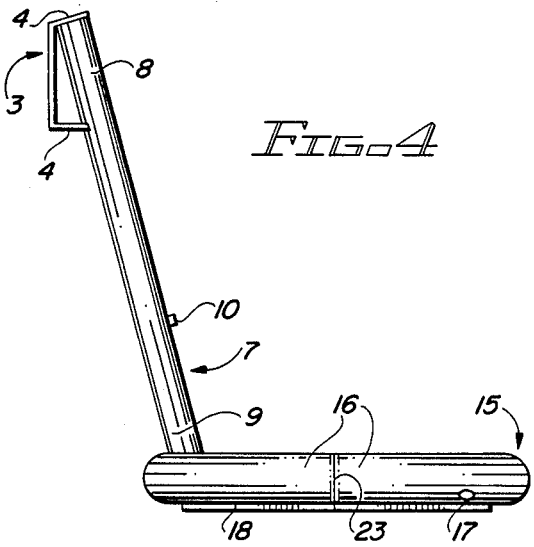
FIG. 4 is a side elevation of the base and backboard support illustrated in FIG. 3.
Figure 2:
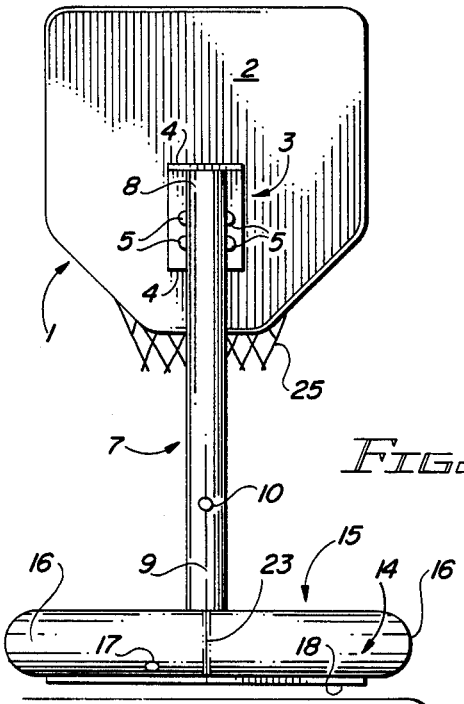
FIG. 2 is a rear elevation of the portable basketball goal illustrated in FIG. 1.
Figure 5:
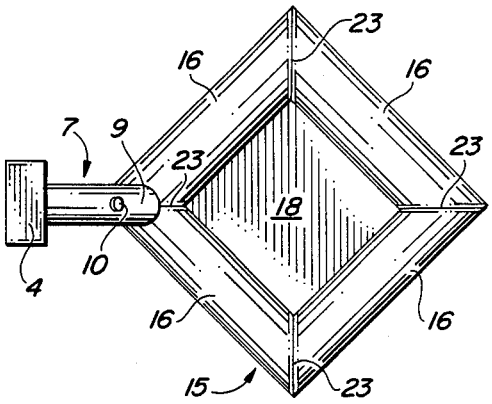
FIG. 5 is a top view of the base and backboard support illustrated in FIGS. 3 and 4.

It will be appreciated by those skilled in the art that the portable basketball goal 1 of this invention is easily moved and relocated on the pool deck 28 of the swimming pool 27 or to any other location when the water ballast is drained from the leg interior 14 of the pipe legs 16 by removing the drain plug 17. This drainage is enhanced by removing the support fill plug 10 or the base fill plug 32, as applicable, to allow air to enter the base end 9 of the backboard support 7 and the leg interior 14 of the pipe legs 16, respectively, and facilitate faster draining of the pipe legs 16. Furthermore, the backboard 2 is easily removed from the backboard support 7 by removing the plate bolts 5 to isolate the base 15 and the backboard support 7 from the backboard 2, as illustrated in FIGS. 3–5. Additionally, under circumstances where the base end 9 of the backboard support 7 is removably attached to the base 15 as illustrated in FIG. 6, the backboard support 7 can be isolated from both the backboard 2 and the base 15 by removing the base end bolt 13. This facility is advantageous under circumstances where the portable basketball goal 1 is to be stored, shipped or transported to another location.

Referring again to FIG. 1 of the drawings it will be further appreciated that the base 15 can be constructed of any selected number of pipe legs 16, of any selected diameter and length, in order to define a desired polygon and create a base 15 of desired size and weight. For example, a smaller base 15 can be constructed of three pipe legs 16 which are joined at leg welds 23 to define a triangle. Similarly, five such pipe legs 16 can be connected at leg welds 23 to define a pentagon, which is capable of containing more liquid and/or non-liquid ballast than the base 15 illustrated in FIGS. 1–5. Furthermore, the base 15 can also be constructed in a circular configuration by using pipe elbows of selected size and diamter, as desired.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A portable basketball goal comprising a base characterized by at least three elongated members having a hollow interior, said elongated members joined to define a polygon; a base plate closing the bottom of said polygon to define a container; a backboard support having one end secured to at least one of said elongated members and the opposite end of said backboard support projecting from said at least one of said elongated members; a backboard carried by said opposite end of said backboard support; and a hoop mounted on said backboard.

2. The portable basketball goal of claim 1 wherein said at least three elongated members is four elongated members and said polygon is a square.

3. The portable basketball goal of claim 1 wherein at least the lower segment of said backboard support is provided with an internal opening and said hollow interior of said elongated members communicates with said internal opening for receiving liquid ballast.

4. The portable basketball goal of claim 1 wherein:

(a) said at least three elongated members is four elongated members and said polygon is a square; and (b) at least lower segment of said backboard support is provided with an internal opening and said hollow interior of said elongated members communicates with said internal opening for receiving liquid ballast.

5. The portable basketball goal of claim 4 further comprising a support fill plug provided in said lower segment of said backboard support, said support fill plug communicating with said internal opening and a drain plug provided in at least one of said elongated members, said drain plug communicating with said hollow interior, for selectively filling said internal opening and said hollow interior with said liquid ballast and draining said liquid ballast from said internal opening and said hollow interior, respectively.

6. The portable basketball goal of claim 1 further comprising a base fill plug provided in the top one of said elongated members and a drain plug provided in at least one of said elongated members, said base fill plug and said drain plug communicating with said hollow interior, for selectively filling said hollow interior with liquid ballast and draining the liquid ballast from said hollow interior, respectively.

7. The portable basketball goal of claim 1 further comprising a bracket carried by said backboard and wherein said opposite end of said backboard support is secured to said bracket for mounting said backboard to said backboard support.

8. The portable basketball goal of claim 7 wherein said at least three elongated members is four elongated members and said polygon is a square.

9. The portable basketball goal of claim 8 wherein at least the lower segment of said backboard support is provided with an internal opening and said hollow interior of said elongated members communicates with said internal opening for receiving water as ballast.

10. The portable basketball goal of claim 9 further comprising a support fill plug provided in said lower segment of said backboard support, said support fill plug communicating with said internal opening and a drain plug provided in at least one of said elongated members, said drain plug communicating with said hollow interior, for selectively filling said internal opening and said hollow interior with said liquid ballast and draining said liquid ballast from said internal opening and said hollow interior, respectively.

11. The portable basketball goal of claim 7 further comprising a base fill plug provided in the top one of said elongated members and a drain plug provided in at least one of said elongated members, said base fill plug and said drain plug communicating with said hollow interior, for selectively filling said hollow interior with water and draining the water from said hollow interior, respectively.

12. The portable basketball goal of claim 1 further comprising receptacle means provided in said at least one of said elongated members for receiving said one end of said backboard support and fastening means provided in said receptacle means for engaging said one end of said backboard support and securing said one end of said backboard support in said receptacle means.

13. The portable basketball goal of claim 12 wherein said receptacle means further comprises a sleeve, a sleeve plate welded in said sleeve and a sleeve plate opening provided in said sleeve plate; said fastening means further comprises a bolt adapted for registration with said sleeve plate opening; and further comprising a base end plate provided in said one end of said backboard support, a base end plate opening provided in said base end plate and a nut carried by said base end plate adjacent said base end plate opening, whereby said bolt projects through said sleeve plate opening in said sleeve plate and said end plate opening in said end plate and threadibly engages said nut for removably mounting said one end of said backboard support to said at least one of said elongated members.

14. The portable basketball goal of claim 12 wherein said at least three elongated members is four elongated members and said polygon is a square.

15. The portable basketball goal of claim 14 further comprising a base fill plug provided in the top one of said elongated members and a drain plug provided in at least one of said elongated members, said base fill plug and said drain plug communicating with said hollow interior, for selectively filling said hollow interior with water and draining the water from said hollow interior, respectively.

16. The portable basketball goal of claim 15 further comprising a bracket secured to said backboard and wherein said opposite end of said backboard support is secured to said bracket for mounting said backboard to said backboard support.

17. The portable basketball goal of claim 16 wherein said receptacle means further comprises a sleeve, a sleeve plate welded in said sleeve and a sleeve plate opening provided in said sleeve plate; said fastening means further comprisies a bolt adapted for registration with said sleeve plate opening; and further comprising a base end plate provided in said one end of said backboard support, a base end plate opening provided in said base end plate and a nut carried by said base end plate adjacent said base end plate opening, whereby said bolt projects through said sleeve plate opening in said sleeve plate and said end plate opening in said end plate and threadibly engages said nut for removably mounting said one end of said backboard support to said at least one of said elongated members.

18. A portable basketball goal for location on the pool deck of a swimming pool, comprising a base characterized by a plurality of hollow, elongated members joined in end-to-end relationship at junctions to define a polygon having a hollow interior; a base plate closing the bottom of said polygon to define a container; an elongated backboard support having one end attached to two of said elongated members at one of said junctions and the opposite end of said backboard support projecting upwardly from said base in angular relationship; a backboard carried by said opposite end of said backboard support; and a basketball hoop mounted on said backboard, whereby when said base is located on the pool deck, said backboard and basketball hoop project over the water in the swimming pool.

19. The portable basketball goal of claim 18 wherein said plurality of hollow elongated members is four hollow elongated members and said polygon is a square.

20. The portable basketball goal of claim 19 wherein at least the lower segment of said backboard support is provided with an internal opening for receiving liquid ballast.

21. The portable basketball goal of claim 20 further comprising a support fill plug provided in said lower segment of said backboard support, said support fill plug communicating with said internal opening and a drain plug provided in at least one of said elongated members, said drain plug communicating with said hollow interior, for selectively filling said internal opening and said hollow interior with said liquid ballast and draining said liquid ballast from said internal opening and said hollow interior, respectively.

22. The portable basketball goal of claim 18 further comprising a base fill plug provided in the top one of said elongated members and a drain plug provided in at least one of said elongated members, said base fill plug and said drain plug communicating with said hollow interior, for selectively filling hollow interior with liquid ballast and draining the liquid ballast from said hollow interior, respectively.

23. The portable basketball goal of claim 18 further comprising a bracket carried by said backboard and wherein said opposite end of said backboard support is secured to said bracket for mounting said backboard to said backboard support.

24. The portable basketball goal of claim 18 further comprising receptacle means provided in said at least one of said elongated members for receiving said one end of said backboard support and fastening means provided in said receptacle means for engaging said one end of said backboard support and securing said one end of said backboard support in said receptacle means.

25. The portable basketball goal of claim 24 wherein said receptacle means further comprises a sleeve, a sleeve plate welded in said sleeve and a sleeve plate opening provided in said sleeve plate; said fastening means further comprises a bolt adapted for registration with said sleeve plate opening; and further comprising a base end plate provided in said one end of said backboard support, a base end plate opening provided in said base end plate and a nut carried by said base end plate adjacent said base end plate opening, whereby said bolt projects through said sleeve plate opening in said sleeve plate and said end plate opening in said end plate and threadibly engages said nut for removably mounting said one end of said backboard support to said at least one of said elongated members.

26. The portable basketball goal of claim 25 further comprising:

(a) a bracket carried by said backboard and wherein said opposite end of said backboard support is secured to said bracket for mounting said backboard to said backboard support; and (b) a base fill plug provided in the top one of said elongated members and a drain plug provided in at least one of said elongated members, said base fill plug and said drain plug communicating with said hollow interior, for selectively filling said hollow interior with liquid ballast and draining the liquid ballast from said hollow interior, respectively.

27. A portable basketball goal for location on the deck of a swimming pool, comprising a base characterized by four pipe segments joined together at welded seams in the configuration of a square; a base plate closing the bottom of said pipe segments to define a container; a backboard support having one end carried by two of said pipe segments at one of said welded seams and the opposite end of said backboard support projecting from said pipe segments; a backboard carried by said opposite end of said backboard support; and a hoop mounted on said backboard, whereby said backboard and said hoop are projected over the swimming pool when said base is located on said deck.

28. The portable basketball goal of claim 27 further comprising a bracket carried by said backboard and wherein said opposite end of said backboard support is secured to said bracket for mounting said backboard to said backboard support.

29. The portable basketball goal of claim 28 further comprising receptacle means provided in said one of said welded seams provided in two of said pipe segments for receiving said one end of said backboard support and fastening means provided in said receptacle means for engaging said one end of said backboard support and securing said one end of said backboard support in said receptacle means.

30. The portable basketball goal of claim 29 further comprising a base fill plug provided in the top one of said pipe segments and a drain plug provided in at least one of said pipe segments, said base fill plug and said drain plug communicating with the hollow interior of said pipe segments, for selectively filling said hollow interior with water and draining the water from said hollow interior, respectively.

31. The portable basketball goal of claim 30 wherein said receptacle means further comprises a sleeve, a sleeve plate welded in said sleeve and a sleeve plate opening provided in said sleeve plate; said fastening means further comprises a bolt adapted for registration with said sleeve plate opening; and further comprising a base end plate provided in said one end of said backboard support, a base end plate opening provided in said base end plate and a nut carried by said base end plate adjacent said base end plate opening, whereby said bolt projects through said sleeve plate opening in said sleeve plate and said end plate opening in said end plate and threadibly engages said nut for removably mounting said one end of said backboard support to said one of said welded seams provided in two of said pipe segments.

32. The portable basketball goal of claim 28 further comprising a support fill plug provided in said lower segment of said backboard support, said support fill plug communicating with said internal opening and a drain plug provided in at least one of said pipe segments, said drain plug communicating with the hollow interior in said pipe segments, for selectively filling said internal opening and said hollow interior with said liquid ballast and draining said liquid ballast from said internal opening and said hollow interior, respectively.

* * * * *